US010214036B2

(12) United States Patent
Kyaw et al.

(10) Patent No.: US 10,214,036 B2
(45) Date of Patent: Feb. 26, 2019

(54) SIMPLIFY JOURNAL TAKE UP CORE MECHANISM

(71) Applicant: TOSHIBA TEC KABUSHIKI KAISHA, Tokyo (JP)

(72) Inventors: Myo Nyunt Kyaw, Singapore (SG); Min Wai Khaing, Singapore (SG); Leonard Tio, Singapore (SG); Tsuyoshi Sanada, Susono Shizuoka (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/692,944

(22) Filed: Aug. 31, 2017

(65) Prior Publication Data

US 2018/0056682 A1 Mar. 1, 2018

(30) Foreign Application Priority Data

Sep. 1, 2016 (JP) ..... 2016-170870

(51) Int. Cl.

| | |
|---|---|
| ***B41J 15/16*** | (2006.01) |
| ***B65H 18/10*** | (2006.01) |
| ***B65H 29/00*** | (2006.01) |
| ***B41J 15/04*** | (2006.01) |
| ***B65H 75/22*** | (2006.01) |
| ***B65H 75/24*** | (2006.01) |
| ***B65H 18/02*** | (2006.01) |
| *B41J 3/407* | (2006.01) |

(52) U.S. Cl.

CPC ..... *B41J 15/16* (2013.01); *B41J 15/042* (2013.01); *B65H 18/028* (2013.01); *B65H 18/10* (2013.01); *B65H 29/006* (2013.01); *B65H 75/22* (2013.01); *B65H 75/241* (2013.01); *B41J 3/4075* (2013.01)

(58) Field of Classification Search

CPC ..... B41J 15/16; B41J 15/042; B41J 3/4075; B65H 18/028; B65H 75/241; B65H 75/22; B65H 29/006; B65H 18/10

See application file for complete search history.

(56) References Cited

U.S. PATENT DOCUMENTS

| | | | | |
|---|---|---|---|---|
| 4,629,136 A * | 12/1986 | Valiance | ..... | B65H 75/22 242/587.2 |
| 7,111,806 B2 * | 9/2006 | Craig | ..... | B65H 75/22 242/118.5 |
| 2003/0156881 A1 * | 8/2003 | Iwata | ..... | B41J 15/042 400/613 |

FOREIGN PATENT DOCUMENTS

| | | |
|---|---|---|
| JP | 2002-087649 | 3/2002 |

* cited by examiner

*Primary Examiner* — Henok Legesse
(74) *Attorney, Agent, or Firm* — Kim & Stewart LLP

(57) ABSTRACT

A sheet winding mechanism includes a detachable winding core, a rotating body coupled to a first end portion of the winding core to rotate the winding core, and a non-rotating body against which a second end of the winding core is pressed. The winding core includes a winding core main body, a first portion which is located at the first end portion and is coupled to the rotating body, a second portion which is located at the second end portion, is movable in the axial direction, and presses against the non-rotating body, a first elastic body which urges the second portion outward along the axial direction, and a sheet holding portion configured to hold an end portion of a sheet. When the rotating body rotates the winding core while the sheet holding portion is holding the end portion of the sheet, the sheet is wound around the winding core.

20 Claims, 10 Drawing Sheets

SIMPLIFY JOURNAL TAKE UP CORE MECHANISM

CROSS-REFERENCE TO RELATED APPLICATION

This application is based upon and claims the benefit of priority from Japanese Patent Application No. 2016-170870, filed Sep. 1, 2016, the entire contents of which are incorporated herein by reference.

FIELD

Embodiments described herein relate generally to a sheet winding mechanism and a printer.

BACKGROUND

Some apparatuses having a printing function are equipped with a sheet winding mechanism which winds a sheet in a roll shape. For example, in many cases, a merchandise information processing apparatus (for example, a point of sales (POS) terminal) is equipped with a sheet winding mechanism which winds a journal having transaction information printed thereon in a roll shape. The sheet winding mechanism includes a detachable winding core, and winds a sheet around the winding core.

In order to maintain winding performance at a high level and also to enable the user to readily attach or detach a winding core, many sheet winding mechanisms and winding cores are made complicated in configuration. An apparatus complicated in configuration tends to be high in cost. As the cost of an apparatus used for winding (for example, a sheet winding mechanism or a winding core) becomes higher, the cost of the entire printer also becomes higher.

DETAILED DESCRIPTION

Figure 1:
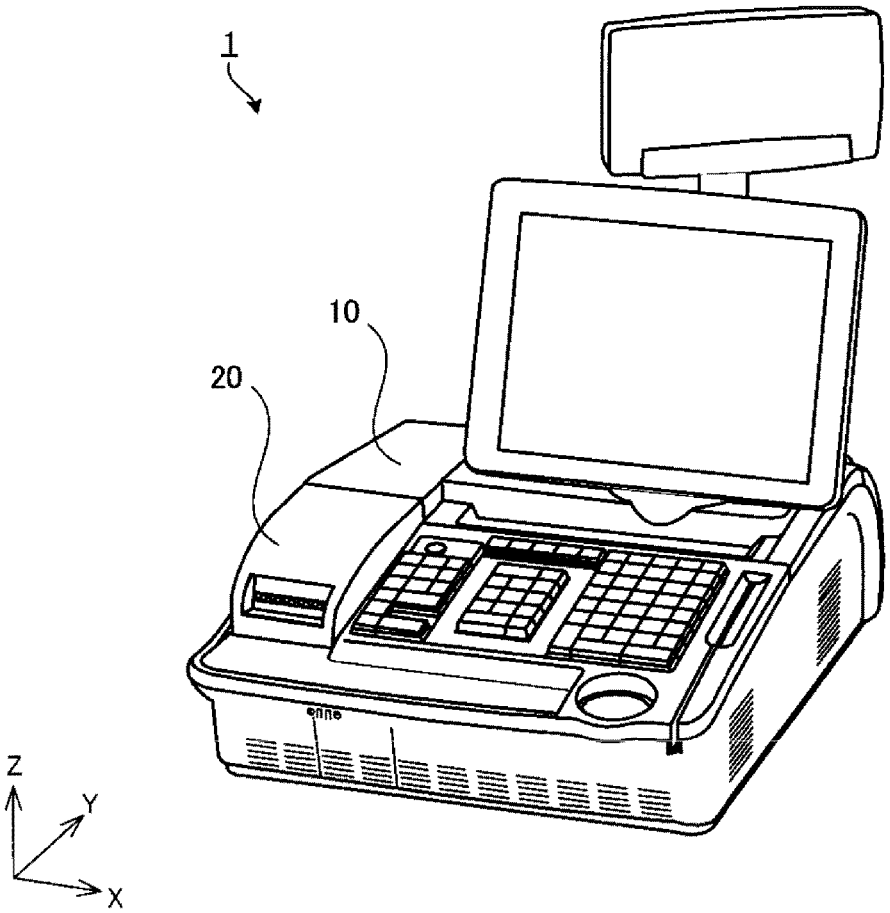
FIG. 1 is a perspective view illustrating a merchandise information processing apparatus equipped with a printer according to an embodiment.

Embodiments are directed to a low-cost configuration for winding a sheet.

In general, according to one embodiment, a sheet winding mechanism includes a detachable winding core, a rotating body which is coupled to a first end portion of the winding core to rotate the winding core, and a non-rotating body against which a second end of the winding core is pressed as the winding core rotates with the rotating body. The winding core includes a winding core main body having an elongated shape, a first portion which is located at the first end portion in an axial direction of the winding core main body and is coupled to the rotating body, a second portion which is located at the second end portion in the axial direction of the winding core main body, is movable in the axial direction, and presses against the non-rotating body, a first elastic body which urges the second portion outward along the axial direction, and a sheet holding portion configured to hold an end portion of a sheet. When the rotating body rotates the winding core while the sheet holding portion is holding the end portion of the sheet, the sheet is wound around the winding core.

Hereinafter, illustrative embodiments will be described with reference to the drawings. Furthermore, in the drawings, the same or similar components are assigned the respective same reference characters.

FIG. 1 is a perspective view illustrating a merchandise information processing apparatus 1 according to an embodiment. The merchandise information processing apparatus 1 is, for example, a point of sales (POS) terminal. The merchandise information processing apparatus 1 is installed at each store and is to be operated by store personnel. The merchandise information processing apparatus 1 is connected to a store server (e.g., POS server (not illustrated)) via a network. The merchandise information processing apparatus 1 is equipped with a printer 10 for printing journal information in addition to a printer 20 for issuing a receipt. The journal information is transaction information (historical information about transactions) such as sales data. The printer 10 is fixed to or incorporated in the merchandise information processing apparatus 1.

Furthermore, in the following description, an orthogonal coordinate system configured with an X-axis, a Y-axis, and a Z-axis is used. In the drawings, the direction indicated by an arrow is a plus direction. The X-axis plus direction is the rightward direction, and the X-axis minus direction is the leftward direction. Moreover, the Y-axis plus direction is the rearward direction (backward), and the Y-axis minus direction is the frontward direction (forward). Additionally, the Z-axis plus direction is the upward direction, and the Z-axis minus direction is the downward direction.

Figure 2:
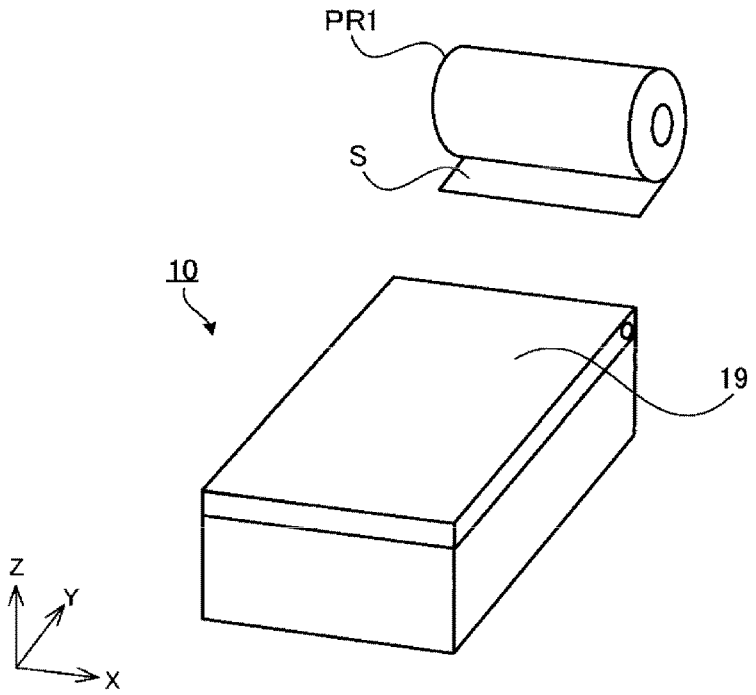
FIG. 2 is a perspective view of the printer according to the embodiment.

FIG. 2 illustrates the printer 10 in the state of being extracted from the merchandise information processing apparatus 1. The printer 10 is a journal printer used to print journal information. The printer 10 is equipped with a cover 19 at an upper portion thereof, and is able to load a roll of paper PR1 in the interior thereof. The roll of paper PR1 is a roll-shaped printing medium in which a sheet S is rolled. The printer 10 extracts the sheet S from the roll of paper PR1 and prints journal information on the sheet S. The sheet S having journal information printed thereon is then wound around a winding core by a sheet winding mechanism, which is described below. In the following description, a sheet having journal information printed thereon is referred to as a "journal". The appearances illustrated in FIG. 1 and FIG. 2 are merely examples, and can be modified in various manners.

Figure 3:
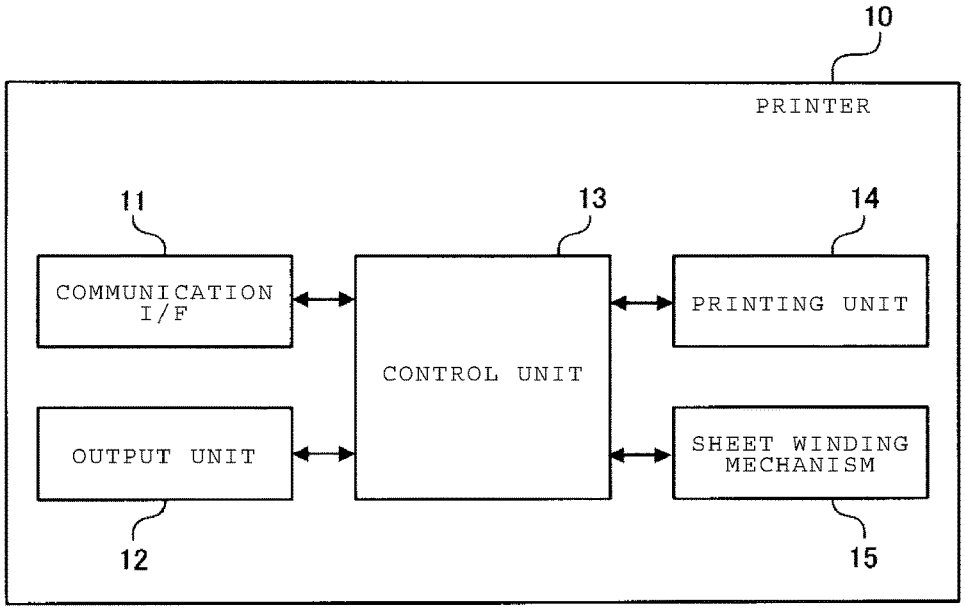
FIG. 3 is a block diagram of the printer according to the embodiment.

FIG. 3 is a block diagram of the printer 10. The printer 10 includes a communication interface 11, an output unit 12, a control unit 13, a printing unit 14, and a sheet winding mechanism 15.

The communication interface 11 is a communication interface which communicates with a control device (for example, a processor) of the merchandise information processing apparatus 1. The communication interface 11 acquires various pieces of data from the merchandise information processing apparatus 1. Data which the communication interface 11 acquires from the merchandise information processing apparatus 1 includes information which the printing unit 14 prints on the sheet S (for example, journal information).

The output unit 12 is an output device used to inform the user of information. The output unit 12 is, for example, a sound-producing apparatus, such as a loudspeaker or a buzzer. The output unit 12 can be a display device, such as a liquid crystal display and an organic electroluminescence (EL) display. The output unit 12 informs the user of, for example, running out of paper on the roll of paper PR1 or the occurrence of a conveyance abnormality of the sheet S.

The control unit 13 is configured with a processing device such as a processor. The control unit 13 functions as a control device that controls each unit of the printer 10. The control unit 13 operates according to a program stored in a storage device (a read-only memory (ROM) and/or a random access memory (RAM)) inside the control unit 13 or outside the control unit 13, thus implementing various operations, such as winding control for the sheet S.

Figure 4:
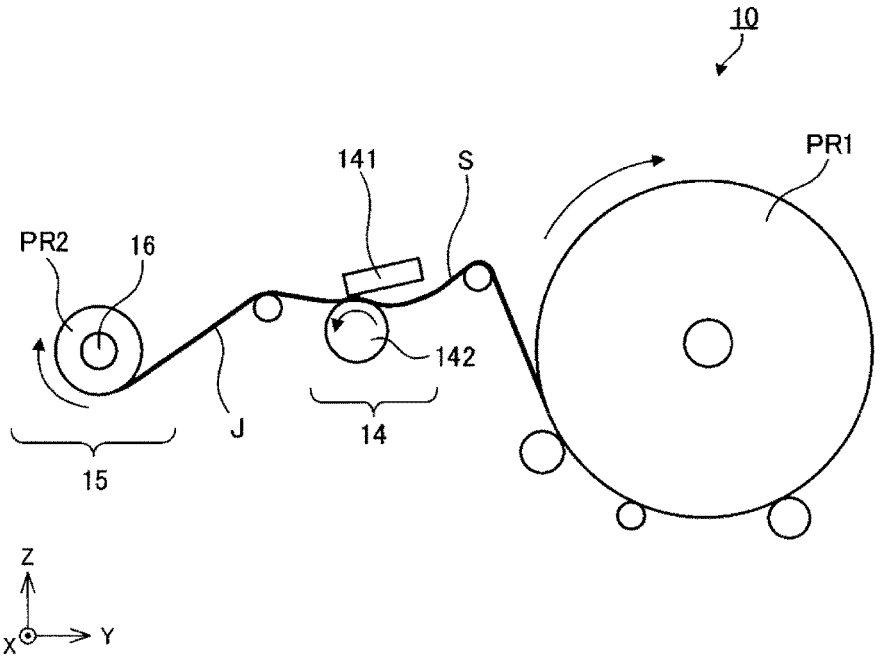
FIG. 4 is a diagram illustrating an internal structure of the printer according to the embodiment.

FIG. 4 is a diagram illustrating an internal structure of the printer 10. The printer 10 includes the printing unit 14 and the sheet winding mechanism 15. The printer 10 is configured to allow the roll of paper PR1 to be attached thereto and detached therefrom. Furthermore, the sheet winding mechanism 15 is configured to allow a winding core 16 to be attached thereto and detached therefrom. Journal information is printed by the printing unit 14 on the sheet S extracted from the roll of paper PR1. The sheet S having journal information printed thereon is wound as a journal J around the winding core 16 and is then made into a roll of paper PR2.

The printing unit 14 prints various pieces of information, such as journal information, on the sheet S. The printing unit 14 is a thermal-type print unit. The printing unit 14 includes a print head 141 and a roller 142. The print head 141 is a thermal head, and the roller 142 is a platen roller. The roller 142 also serves as a conveyance unit that conveys the sheet S. The printing unit 14 prints information on the sheet S according to control performed by the control unit 13.

Figure 5:
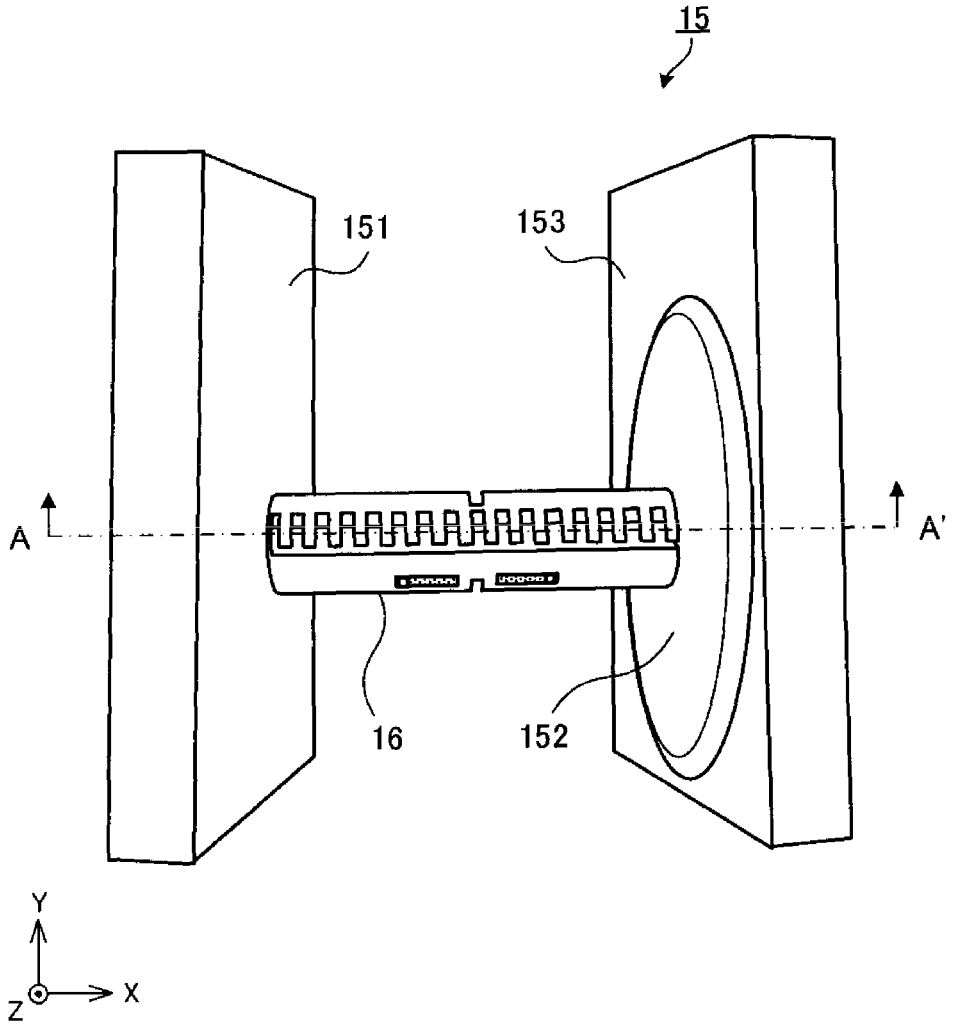
FIG. 5 is a diagram illustrating a sheet winding mechanism as viewed from above.
Figure 6:
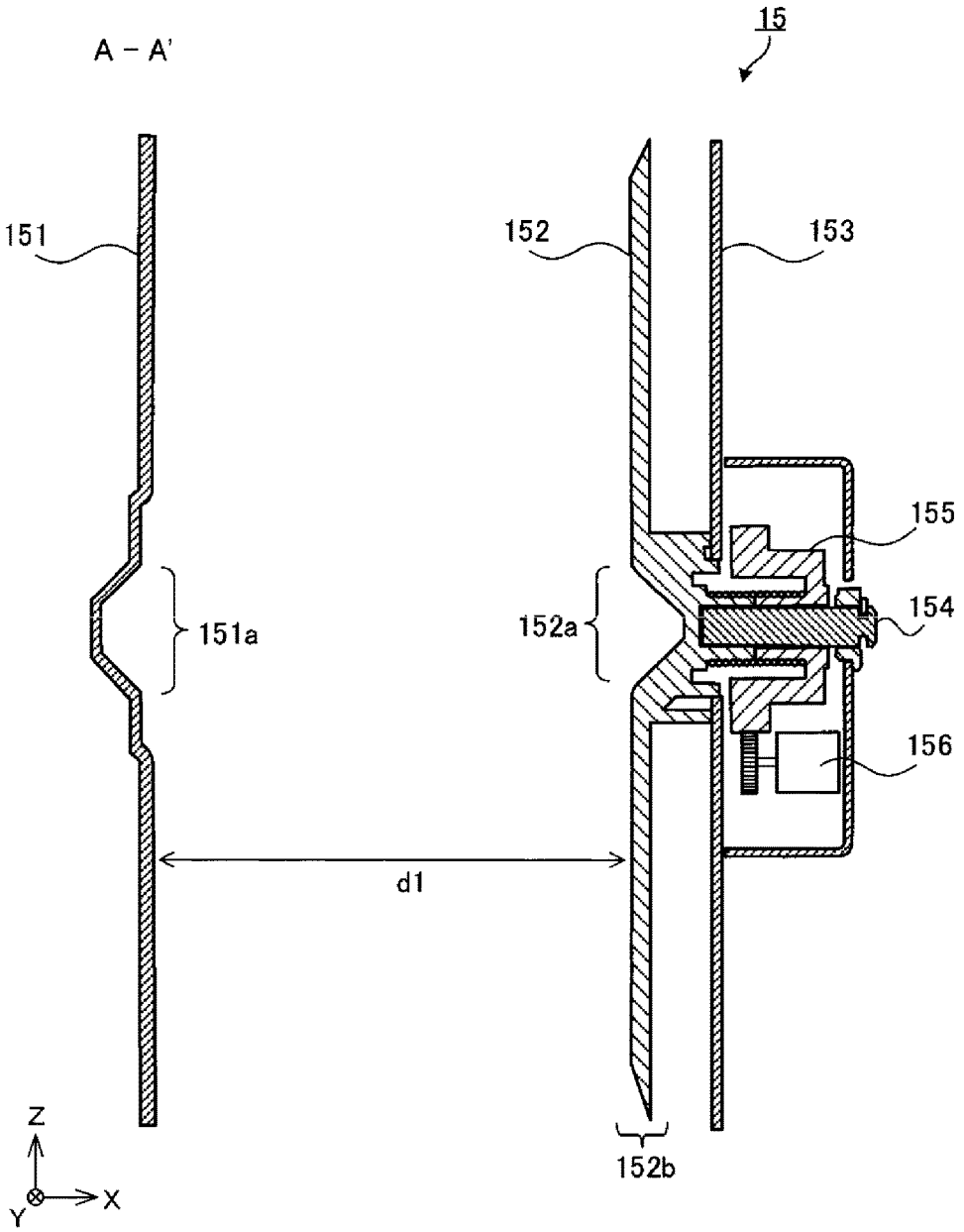
FIG. 6 is a sectional view of the sheet winding mechanism.

The sheet winding mechanism 15 is a mechanism configured to wind the sheet S having journal information printed thereon (i.e., the journal J) around the winding core 16. FIG. 5 is a diagram illustrating the sheet winding mechanism 15 as viewed from above. FIG. 6 is a sectional view taken along line A-A' of the sheet winding mechanism 15 illustrated in FIG. 5. FIG. 6 illustrates a condition in which the winding core 16 is removed. The sheet winding mechanism 15 includes a rotating body 152, non-rotating bodies 151 and 153, and the winding core 16.

The rotating body 152 is a rotating component configured to rotationally drive the winding core 16. The rotating body 152 includes a disk-shaped flat plate portion 152*b*. The diameter of the flat plate portion 152*b* is slightly larger than the diameter of a new roll of paper PR1 (in other words, the diameter of the roll of paper PR2 when reaching the maximum level). The rotating body 152 is fixed to the non-rotating body 153 in such a way as to be rotatable with one flat surface of the flat plate portion 152*b* facing the winding core 16 (facing in the X-axis minus direction). The non-rotating body 153 is a member that does not rotate together with the winding core 16, for example, a chassis of the printer 10. A shaft 154 is fixed to the rotating body 152. The shaft 154 is fixed to the non-rotating body 153 via, for example, a bearing. The rotating body 152 rotates around the shaft 154.

The sheet winding mechanism 15 further includes a motor 156 serving as a drive power source to rotate the rotating body 152. The motor 156 operates according to control provided by the control unit 13. The sheet winding mechanism 15 further includes a power transmission portion 155 which transmits drive power of the motor 156 to the rotating body 152. The power transmission portion 155 is, for example, a gear or a clutch.

In the example illustrated in FIG. 6, the power transmission portion 155 serves as a part of a friction clutch. The power transmission portion 155 configures the friction clutch in combination with a part of the rotating body 152 (a portion protruding in the X-axis plus direction from the flat plate portion 152*b*). The power transmission portion 155 rotates the rotating body 152 by a frictional force occurring between the rotating body 152 and the power transmission portion 155. Furthermore, if the rotating body 152 is not rotated even when a given level of load or more is applied thereto, the power transmission portion 155 rotates in an idle manner. The level of load which causes idle rotation can be determined as appropriate by the apparatus designer. In a case where paper of the roll of paper PR1 has run out, which causes a situation in which the sheet S is no longer able to be extracted from the core of the roll of paper PR1, the power transmission portion 155 rotates in an idle manner such that the rotating body 152 stops rotating.

Figure 7:
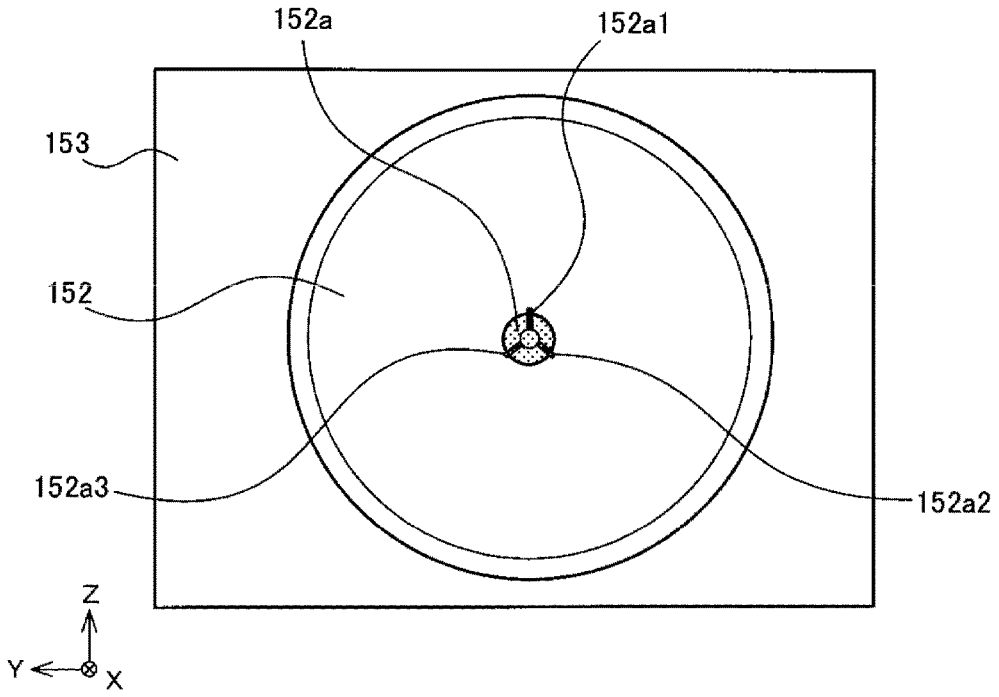
FIG. 7 is a diagram illustrating a rotating body as viewed from the left side.

FIG. 7 is a diagram illustrating the rotating body 152 as viewed from the left side (the X-axis minus direction). The rotating body 152 has a meshed portion 152*a* formed at the center thereof, with which one end portion (in the example illustrated in FIG. 5, the right end portion) of the winding core 16 is meshed. The meshed portion 152*a* is a concave portion in an inverted cone shape. The meshed portion 152*a* has three grooves 152*a*1, 152*a*2, and 152*a*3, which extend radially from the vicinity of the bottom of the concave portion, as illustrated in FIG. 7. These grooves are meshed with claws formed on one end portion of the winding core 16. Furthermore, the shape of the meshed portion 152*a* can be optionally changed. For example, the meshed portion 152*a* can be a concave portion in an inverted hemisphere shape. Naturally, the shape, number, location of grooves formed on the meshed portion 152*a* can also be optionally changed.

Referring back to FIG. 6, each of the non-rotating bodies 151 and 153 is a non-rotating member which does not rotate together with the winding core 16 (in other words, a base body serving as a discriminant criterion for the state of the winding core 16 when rotation is stopped). For example, the non-rotating body 151 or 153 is a chassis or a frame to which the rotating body 152 is directly or indirectly fixed. The chassis can be a chassis of the printer 10 or a chassis of the sheet winding mechanism 15. Furthermore, the frame can be a frame of the printer 10 or a frame of the sheet winding mechanism 15. Moreover, the non-rotating body 151 or 153 is not limited to a chassis or a frame. The non-rotating body 151 or 153 can be a fixed member which is directly or indirectly fixed to a chassis or a frame. The non-rotating body 151 and the non-rotating body 153 can be separate from each other or can be an integrated member.

Figure 8:
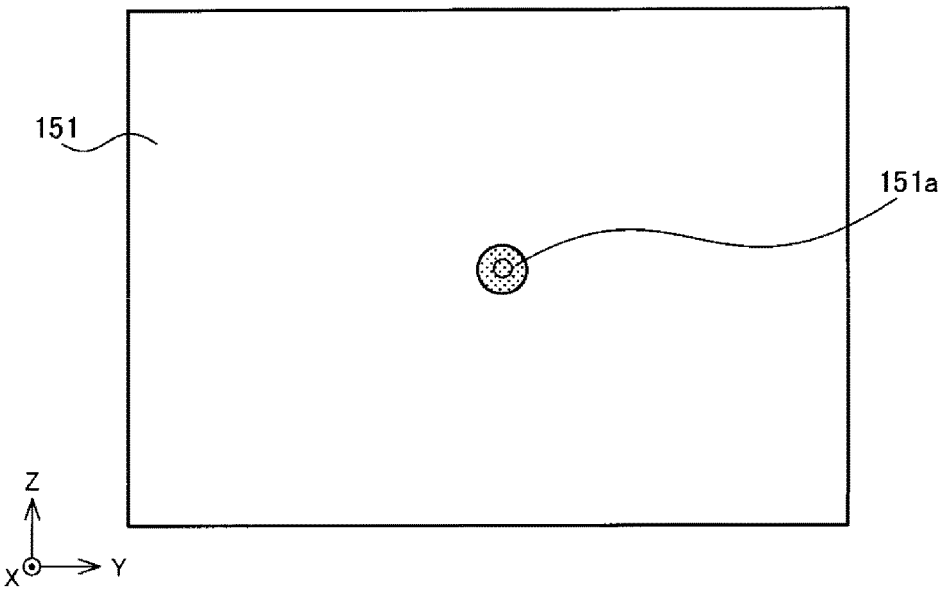
FIG. 8 is a diagram illustrating a non-rotating body as viewed from the right side.

The non-rotating body 151 has a flat surface parallel to the flat plate portion 152*b* of the rotating body 152. The non-rotating body 151 is located in such a manner that the flat surface thereof faces the winding core 16 (in the X-axis plus direction). The non-rotating body 151 and the rotating body 152 are spaced from each other by about a width d1. FIG. 8 is a diagram illustrating the non-rotating body 151 as viewed from the right side (the X-axis plus direction). The non-rotating body 151 has a fitted portion 151*a* formed therein, which is fitted to the other end portion (in the example illustrated in FIG. 5, the left end portion) of the winding core 16. The fitted portion 151*a* faces the meshed portion 152*a* of the rotating body 152 as illustrated in FIG. 6. The fitted portion 151*a* is a concave portion in an inverted cone shape. The fitted portion 151*a* has no grooves or claws formed therein, and the surface of the fitted portion 151*a* is smooth. Furthermore, the shape of the fitted portion 151*a* can be optionally changed. For example, the fitted portion 151*a* can be a concave portion in an inverted hemisphere shape.

Figure 9:
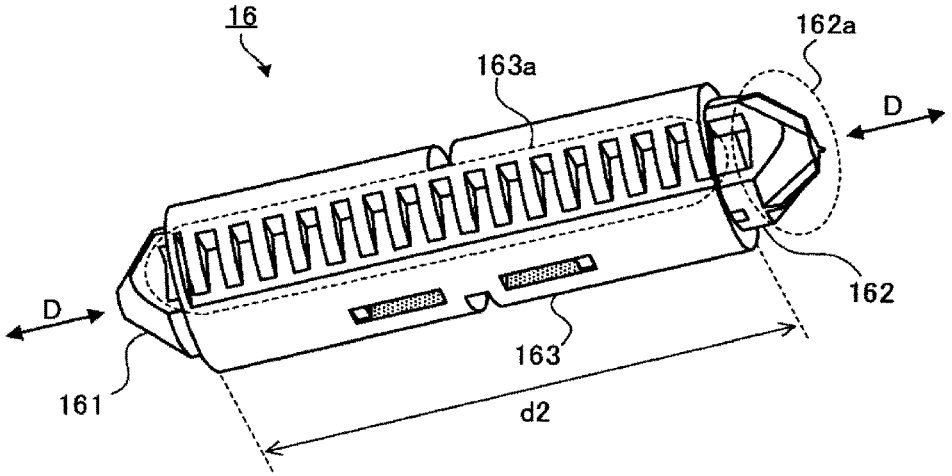
FIG. 9 is a perspective view of a winding core.

FIG. 9 is a perspective view of the winding core 16. One end portion of the winding core 16 is fitted to the fitted portion 151*a*, and the other end portion of the winding core 16 is meshed with the meshed portion 152*a*. The winding core 16 includes a winding core main body 163 and movable portions 161 and 162.

The winding core main body 163 is a member having a column shape. While the winding core main body 163 illustrated in FIG. 9 is in a column shape, the shape of the winding core main body 163 is not limited to the column shape. For example, the winding core main body 163 can be in a rectangular column shape, or can be in an elliptic column shape. The width d2 in the axial direction D of the winding core main body 163 is slightly less than the width d1 between the non-rotating body 151 and the rotating body 152 illustrated in FIG. 6.

As illustrated in FIG. 9, the winding core main body 163 has a sheet fixing portion 163*a* formed therein, which is configured to fix the end portion of the sheet S. The sheet fixing portion 163*a* holds the end portion of the sheet S. The sheet fixing portion 163*a* is, for example, a cut formed on the circumferential surface of the winding core main body 163. The cut is formed along the axial direction D of the winding core main body 163. The user can insert the end portion of the sheet S into the cut to cause the winding core 16 to hold the sheet S. An upper portion of the cut is in the shape of comb teeth so as to enable the user to visually check to what degree the end portion of the sheet S is inserted. Furthermore, the sheet fixing portion 163*a* is not limited to a configuration illustrated in FIG. 9. The sheet fixing portion 163*a* can be modified in various shapes as long as it is able to fix the end portion of the sheet S.

The movable portion 161 (first movable portion) is located at one end portion in the axial direction D of the winding core main body 163. Furthermore, the movable portion 162 (second movable portion) is located at the other end portion in the axial direction D of the winding core main body 163. Each of the movable portions 161 and 162 is able to reciprocate along the axial direction D. The movable portions 161 and 162 rotate together with the winding core main body 163.

Figure 10:
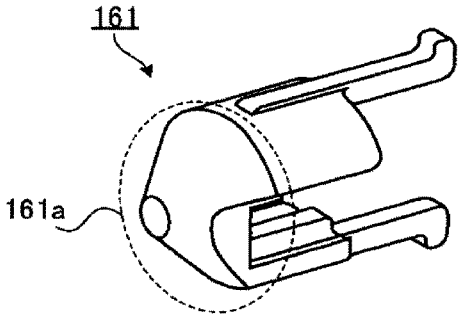
FIG. 10 is a perspective view of a first movable portion.

FIG. 10 is a perspective view of the movable portion 161 (first movable portion). The movable portion 161 has a fitting portion 161*a* at a tip thereof. The fitting portion 161*a* is in such a shape as to be able to be fitted to the fitted portion 151*a* of the non-rotating body 151 shown in FIG. 8. In the example illustrated in FIG. 10, the fitting portion 161*a* is a convex portion in a cone shape which is a size smaller than the fitted portion 151*a*. The fitting portion 161*a* has no grooves or claws formed therein, and the surface of the fitting portion 161*a* is smooth. Therefore, even when rotating together with the winding core main body 163, the fitting portion 161*a* never receives a large rotational resistance force (e.g., frictional force) from the non-rotating body 151.

Figure 11:
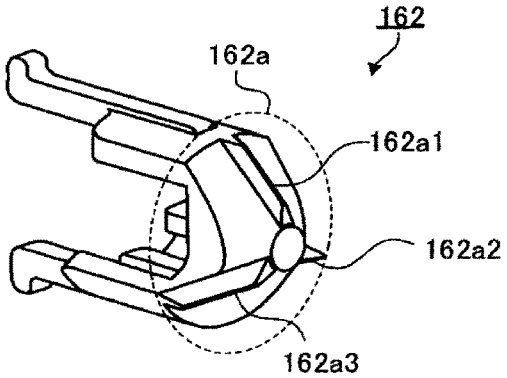
FIG. 11 is a perspective view of a second movable portion.

FIG. 11 is a perspective view of the movable portion 162. The movable portion 162 has a meshing portion 162*a* at a tip thereof. The meshing portion 162*a* is in such a shape as to be able to be at least partially received within the meshed portion 152*a* of the rotating body 152 shown in FIG. 7. In the example illustrated in FIG. 11, the meshing portion 162*a* is a convex portion in a cone shape which is approximately equal in size to the meshed portion 152*a*. Claws 162*a*1, 162*a*2, and 162*a*3, which are able to be meshed with the grooves 152*a*1, 152*a*2, and 152*a*3 of the meshed portion 152*a* shown in FIG. 7, are formed on the circumferential surface of the convex portion. At the time of mounting of the winding core 16, the claws 162*a*1, 162*a*2, and 162*a*3 are meshed with the grooves of the rotating body 152 (the grooves 152*a*1, 152*a*2, and 152*a*3 illustrated in FIG. 7). With this, a rotational force of the rotating body 152 is transmitted to the winding core 16.

Figure 12:
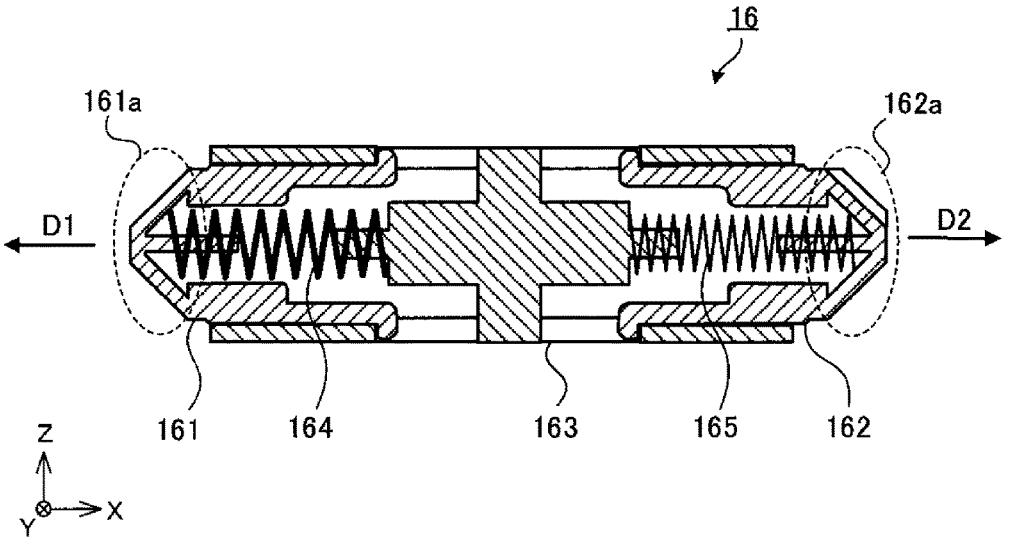
FIG. 12 is a sectional view of the winding core.

FIG. 12 is a sectional view of the winding core 16. Each of the movable portions 161 and 162 are fixed to the winding core main body 163 in such a way as to be able to reciprocate. Elastic bodies 164 and 165, which respectively urge the movable portions 161 and 162 toward the outward along the axial direction D (hereinafter referred to as the "outward axial direction"), are arranged inside the winding core main body 163. Here, the term "outward axial direction" refers to a direction opposite to the direction to move toward the center of the winding core main body 163 along the axial direction D of the winding core main body 163. In the case of the movable portion 161, the outward axial direction is a direction D1 illustrated in FIG. 12, and, in the case of the movable portion 162, the outward axial direction is a direction D2 illustrated in FIG. 12.

Each of the elastic bodies 164 and 165 is a single spring. The elastic body 164 has one end portion which is in contact with the winding core main body 163 and the other end portion which is in contact with the movable portion 161. Furthermore, the elastic body 165 has one end portion which is in contact with the winding core main body 163 and the other end portion which is in contact with the movable portion 162. The elastic body 164 urges the movable portion 161 toward the outward axial direction D1, and the elastic body 165 urges the movable portion 162 toward the outward axial direction D2. The spring constant of the elastic body 164 is greater than the spring constant of the elastic body 165. Therefore, the elastic body 164 urges the movable portion 161 in the outward axial direction D1 with a force greater than the force with which the elastic body 165 urges the movable portion 162 in the outward axial direction D2.

Next, a sheet winding method using the printer 10 and the sheet winding mechanism 15 configured described above is described.

Figure 13:
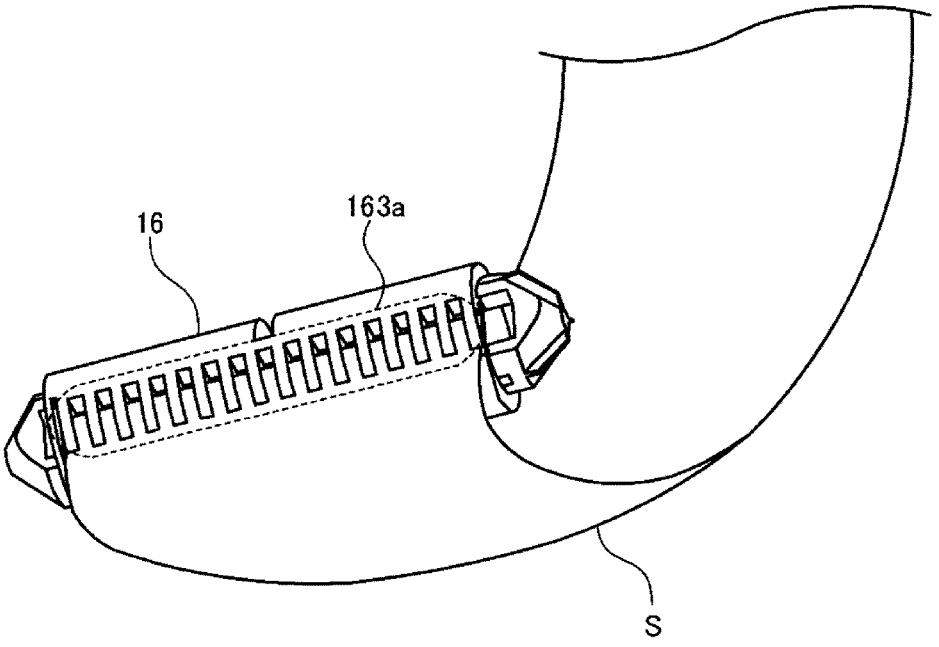
FIG. 13 is a diagram illustrating a condition in which the end portion of a sheet is fixed to the winding core.

First, the user prepares a roll of paper PR1 and the winding core 16. The sheet S is still not wound around the winding core 16. After opening the cover 19 of the sheet winding mechanism 15, the user sets the roll of paper PR1 and then pulls out the sheet S from the roll of paper PR1. Then, the user inserts the end portion of the sheet S into the sheet fixing portion 163*a* to fix the end portion of the sheet S to the winding core 16. FIG. 13 is a diagram illustrating a condition in which the end portion of the sheet S is fixed to the winding core 16.

Figure 14:
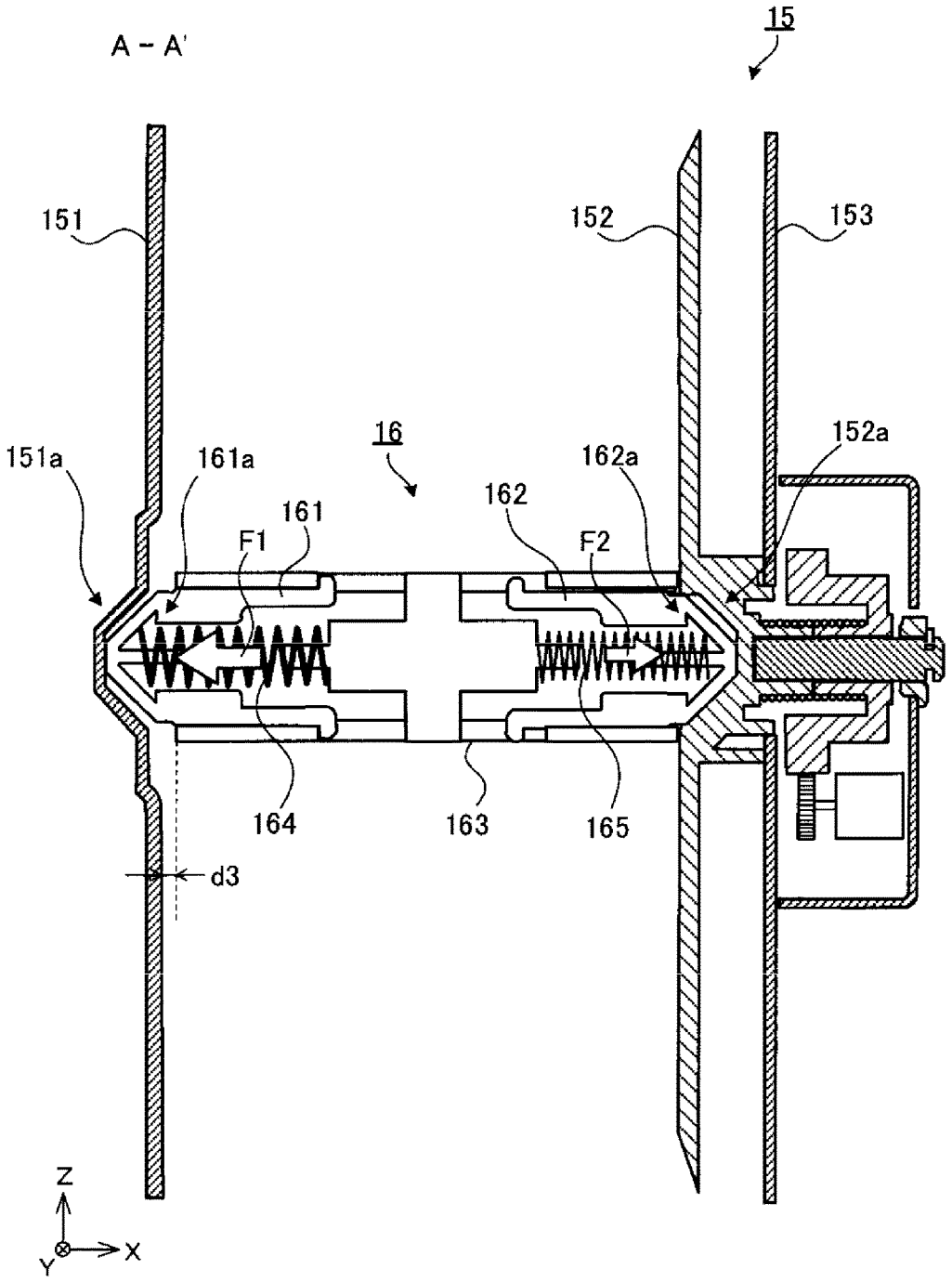
FIG. 14 is a diagram illustrating a condition in which the winding core is mounted in the sheet winding mechanism.

After completing fixing the sheet S, the user mounts the winding core 16 in the sheet winding mechanism 15. FIG. 14 is a diagram illustrating a condition in which the winding core 16 is mounted in the sheet winding mechanism 15. In the illustration of FIG. 14, in order to facilitate viewing the state of the sheet winding mechanism 15, some hatching indicating cross-sections are omitted for clarity. The method of mounting the winding core 16 is, for example, as follows.

First, the user presses the movable portions 161 and 162 of the winding core 16 into the winding core main body 163 with the user's fingers. Then, the user inserts the winding core 16 between the non-rotating body 151 and the rotating body 152 in such a manner that the axial direction D of the winding core 16 becomes normal to the surfaces of the non-rotating body 151 and the rotating body 152. At this time, the user inserts the winding core 16 in such a way that the movable portion 161 of the winding core 16 faces the non-rotating body 151 and the movable portion 162 of the winding core 16 faces the rotating body 152. Then, while maintaining the orientation of the winding core 16, the user presses the winding core 16 until the winding core 16 arrives at a predetermined position (i.e., the positions where the fitted portion 151*a* and the meshed portion 152*a* are present).

As mentioned above, the movable portions 161 and 162 are urged by the elastic bodies 164 and 165 toward the outward axial direction D1 and the outward axial direction D2, respectively. When the winding core 16 arrives at the predetermined position, the tips of the movable portions 161 and 162 are set in the fitted portion 151*a* and the meshed portion 152*a* by being pushed by the elastic bodies 164 and 165, respectively. More specifically, the fitting portion 161*a* of the movable portion 161 is fitted to the fitted portion 151*a* of the non-rotating body 151, and the meshing portion 162*a* of the movable portion 162 is meshed with the meshed portion 152*a* of the rotating body 152.

The spring constant of the elastic body 164 is greater than the spring constant of the elastic body 165. Therefore, a spring force F1 with which the elastic body 164 pushes the movable portion 161 is larger than a spring force F2 with which the elastic body 165 pushes the movable portion 162. As a result, since the winding core main body 163 receives a force acting toward the rotating body 152, the position of the winding core main body 163 is biased toward the rotating body 152. In the example illustrated in FIG. 14, a gap d3 is formed between the left end portion of the winding core main body 163 and the non-rotating body 151. The right end portion of the winding core main body 163 is in close contact with the rotating body 152, and the meshing portion 162*a* is firmly pressed against the meshed portion 152*a* of the rotating body 152.

After completing mounting the winding core 16, the user closes the cover 19 of the sheet winding mechanism 15 and then activates the printer 10. At this time, the user can activate the printer 10 via a user interface of the merchandise information processing apparatus 1. The control unit 13 controls the printing unit 14 to print journal information on the sheet S and, at the same time, controls the motor 156 to rotate the rotating body 152. The winding core 16 rotates with the rotation of the rotating body 152. With this, the sheet S having journal information printed thereon (i.e., the journal J) is wound around the winding core 16. As the journal J is wound, a roll of paper PR2 is formed around the winding core 16.

When the roll of paper PR1 is exhausted (has been used up), the winding core 16 stops rotating. The printer 10 or the printing unit 14 can be equipped with a detection unit which detects run-out of the roll of paper PR1 (when the paper has been used up), and can inform the user of run-out of the roll of paper PR1 via the output unit 12 or the communication interface 11. When the roll of paper PR1 is run out, the user removes the winding core 16 having a roll of paper PR2 formed therearound from the sheet winding mechanism 15. Then, the user replaces the winding core 16 and the roll of paper PR1 with new ones. Furthermore, the printer 10 or the sheet winding mechanism 15 is equipped with a detection unit which detects rotation of the rotating body 152, and, when the printing unit 14 stops rotation and the sheet is no longer conveyed from the printing unit 14, the winding core 16 also stops rotating.

According to the present embodiment, winding of a sheet is enabled with a low-cost configuration. In order to set a rotating body in the sheet winding mechanism 15, besides the rotating body itself, components for rotating the rotating body (for example, a bearing and a shaft) are required. Moreover, a process for mounting the rotating body is also required. In the sheet winding mechanism 15 according to the present embodiment, as illustrated in FIG. 14, the rotating body 152 is set only on the side of one end portion (the X-axis plus direction side) of the winding core 16, and no rotating body is set on the side of the other end portion (the X-axis minus direction side) thereof. Accordingly, the sheet winding mechanism 15 is made low in cost by at least one of a reduction in number of components and a reduction in a manufacturing process. As a result, the user is enabled to wind the sheet S around the winding core 16 with a low-cost configuration. Moreover, since the number of components is decreased, malfunction is less likely to occur.

Furthermore, since the rotating body 152 is set only on the side of one end portion of the winding core 16, the winding core 16 does not necessarily need to have meshing portions at both sides. A meshing portion has to be meshed with a meshed portion of the rotating body, and also has to receive drive power from the rotating body. Therefore, the meshing portion is required to have both such a precise shape as to be meshed with the meshed portion and a strength for receiving drive power. In the winding core 16 in the present embodiment, only one end portion thereof is formed as the meshing portion 162*a*. Since the decrease in number of meshing portions makes the winding core 16 low in cost, winding of the sheet S with a low-cost configuration is enabled.

Furthermore, in a case where only one end portion of the winding core 16 is supported by a rotating body, the other end portion of the winding core 16 would be supported by a non-rotating body. In that case, since the other end portion of the winding core 16 would receive rotational resistance force from the non-rotating body, it would be difficult for the winding core 16 to rotate, as compared with a case where both end portions are supported by respective rotating bodies. In this case, if the meshing portion 162*a* and the meshed portion 152*a* are not firmly meshed with each other, drive power may not be smoothly transmitted from the rotating body 152 to the winding core 16. However, in the case of the winding core 16 in the present embodiment, as illustrated in FIG. 14, since the spring force F1 of the elastic body 164 is set larger than the spring force F2 of the elastic body 165, the meshing portion 162*a* and the meshed portion 152*a* are firmly meshed with each other. Therefore, although the other end portion of the winding core 16 is supported by the non-rotating body 151, the winding core 16 can smoothly receive drive power from the rotating body 152. As a result, the sheet winding mechanism 15 can maintain high winding performance.

Furthermore, since the spring force F1 of the elastic body 164 is greater than the spring force F2 of the elastic body 165, as illustrated in FIG. 14, a gap d3 is formed between the left end portion of the winding core main body 163 and the non-rotating body 151. Since the side surface of the roll of paper PR2 formed around the winding core 16 is less likely to contact the non-rotating body 151 to serve as rotational resistance, although the other end portion of the winding core 16 is supported by the non-rotating body 151, the sheet winding mechanism 15 can maintain high winding performance.

The above-described embodiment is merely an example, and can be modified in various manners and applied to various usages.

Figure 15:
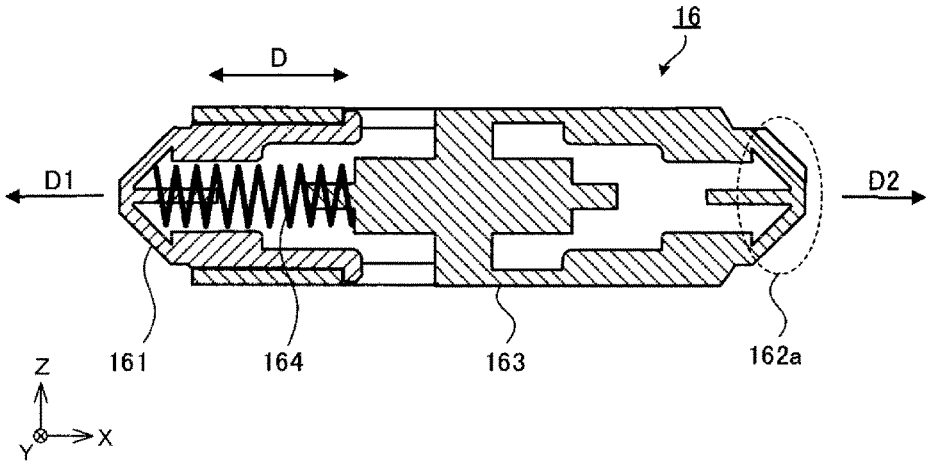
FIG. 15 is a diagram illustrating a modification example of the winding core.

For example, while, in the above-described embodiment, the winding core 16 has two movable portions, i.e., the movable portion 161 and the movable portion 162, the winding core 16 can have a single movable portion. FIG. 15 is a diagram illustrating a winding core 16 which has only a single movable portion. The winding core 16 illustrated in FIG. 15 has only a movable portion 161, and has no movable portion 162. The movable portion 161 is fixed to the left end portion of the winding core main body 163. As with the above-described embodiment, the movable portion 161 is able to reciprocate along the axial direction D. A meshing portion 162*a* is formed on the right end portion of the winding core main body 163. The meshing portion 162*a* is a convex portion which protrudes toward the outward axial direction D2, and is in such a shape as to be able to be meshed with the meshed portion 152*a*. The meshing portion 162*a* is directly formed on the winding core main body 163, and, therefore, rotates with and does not move relative to the winding core main body 163. Furthermore, the meshing portion 162*a* can be formed on a component other than the winding core main body 163, as long as it rotates with and does not move relative to the winding core main body 163. Since the number of movable portions is decreased by one, the cost of the winding core 16 is further reduced.

Moreover, while, in the above-described embodiment, the fitted portion 151*a* is a concave portion and the fitting portion 161*a* is a convex portion, the fitted portion 151*a* can be a convex portion and the fitting portion 161*a* can be a concave portion. Furthermore, while, in the above-described embodiment, the meshed portion 152*a* is a concave portion and the meshing portion 162*a* is a convex portion, the meshed portion 152*a* can be a convex portion and the meshing portion 162*a* can be a concave portion. Additionally, while, in the above-described embodiment, the grooves 152*a*1, 152*a*2, and 152*a*3 are formed at the meshed portion 152*a* and the claws 162*a*1, 162*a*2, and 162*a*3 are formed at the meshing portion 162*a*, claws can be formed at the meshed portion 152*a* and grooves can be formed at the meshing portion 162*a*.

The detection unit included in the printer 10 or the sheet winding mechanism 15, which detects run-out of the roll of paper PR1, can be a load sensor which detects a load applied to the rotating body 152 or can be a light sensor which detects the thickness of the roll of paper PR1 in the radial direction thereof.

Furthermore, while, in the above-described embodiment, each of the elastic bodies 164 and 165 is a single spring, each of the elastic bodies 164 and 165 is not limited to a single spring. For example, the elastic body 164 or 165 can be a body obtained by connecting a plurality of springs in series. Additionally, the elastic body 164 or 165 can be a sponge having a high elastic property.

Moreover, while, in the above-described embodiment, the winding core 16 is a part of the sheet winding mechanism 15, the winding core 16 can be regarded as not a part of the sheet winding mechanism 15 but a configuration independent of the sheet winding mechanism 15. In this case, a portion obtained by excluding the winding core 16 from the sheet winding mechanism 15 can be regarded as the sheet winding mechanism 15.

Besides, while, in the above-described embodiment, the sheet winding mechanism 15 is equipped with the motor 156 as a drive power source for rotating the rotating body 152, the sheet winding mechanism 15 does not necessarily need to be equipped with the motor 156. Drive power for rotating the rotating body 152 can be supplied from the outside of the sheet winding mechanism 15 (for example, the printing unit 14 or the printer 20).

Additionally, while, in the above-described embodiment, after fixing the end portion of the sheet S to the winding core 16, the user mounts the winding core 16 in the sheet winding mechanism 15, the user can fix the end portion of the sheet S to the winding core 16 after mounting the winding core 16 in the sheet winding mechanism 15.

Besides, while, in the above-described embodiment, the printing unit 14 is a thermal-type print unit, the printing unit 14 is not limited to the thermal-type print unit. For example, the printing unit 14 can be a dot impact-type, inkjet-type, or electrophotographic-type print unit.

Moreover, while, in the above-described embodiment, the printer 10 is fixed to or incorporated in the merchandise information processing apparatus 1, the printer 10 can be configured to be externally attachable to the merchandise information processing apparatus 1. For example, the printer 10 can be equipped with a connection interface, such as Universal Serial Bus (USB), and can be configured to be connectable to the merchandise information processing apparatus 1 via a communication cable, such as a USB cable.

Besides, the printer 10 can be equipped with a user interface and can be configured to be able to operate alone independently of the merchandise information processing apparatus 1. Additionally, the printer 10 can be connected to a personal computer and can be configured to operate based on an instruction from the personal computer. Furthermore, while, in the above-described embodiment, the printer 10 is equipped with the output unit 12, the printer 10 does not need to be equipped with the output unit 12. Additionally, while, in the above-described embodiment, the printer 10 and the printer 20 are separate apparatuses, the printer 10 and the printer 20 can be integrated into a single apparatus.

Furthermore, while, in the above-described embodiment, the merchandise information processing apparatus 1 is a POS terminal, the merchandise information processing apparatus 1 is not limited to the POS terminal. For example, the merchandise information processing apparatus 1 can be a stand-alone type cash register which does not have a network connection function.

Moreover, while, in the above-described embodiment, the printer 10 is installed at a POS terminal or a stand-alone type cash register, the apparatus at which the printer 10 is installed is not limited to these. For example, the apparatus at which the printer 10 is installed can be a financial information processing apparatus. The financial information processing apparatus can be an automated teller machine (ATM) in a bank. At this time, the merchandise information processing apparatus 1 can be reworded as a "financial information processing apparatus 1". Naturally, the apparatus at which the printer 10 is installed can be an apparatus other than the merchandise information processing apparatus and the financial information processing apparatus.

Furthermore, in the above-described embodiment, the merchandise information processing apparatus 1 or the financial information processing apparatus 1 has a configuration to which the printer 10 is fixed or in which the printer 10 is incorporated. However, the merchandise information processing apparatus 1 or the financial information processing apparatus 1 can be configured to be able to directly perform printing on the sheet S without involving the printer 10. For example, the merchandise information processing apparatus 1 or the financial information processing apparatus 1 can include the communication interface 11, the output unit 12, the control unit 13, the printing unit 14, and sheet winding mechanism 15. The control unit 13 can be used in common with a control device (for example, a processor) which controls each unit of the merchandise information processing apparatus 1 or the financial information processing apparatus 1. The merchandise information processing apparatus 1 or the financial information processing apparatus 1 can be regarded as the printer 10 itself.

Additionally, while, in the description of the above-described embodiment, the printer 10 is a journal printer, the printer 10 is not limited to the journal printer. For example, the printer 10 can be a label printer. At this time, a roll of paper PR1 to be stored in the printer 10 can be a roll of paper for label printing in which a label printing sheet is rolled. Naturally, the printer 10 can be a printer other than the journal printer and the label printer. For example, the printer 10 can be a printer that performs printing on a receipt or a bank statement. Information which the printer 10 performs printing on the sheet S is not limited to journal information, but can be different information.

Furthermore, in the above-described embodiment, the sheet winding mechanism 15 is set in an apparatus having a printing function (for example, the printer 10), the sheet winding mechanism 15 can be set in a mere sheet winding apparatus, which has no printing function. In this case, the printer 10 can be reworded as a "sheet winding apparatus 10".

Moreover, the sheet S which the sheet winding mechanism 15 winds is not limited to a sheet extracted from a roll of paper. The sheet S can be a mere continuous sheet which is not wound in a roll shape. The continuous sheet can include a label printing sheet.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A sheet winding mechanism comprising:

a detachable winding core;

a rotating body which is coupled to a first end portion of the winding core to rotate the winding core; and a non-rotating body against which a second end of the winding core is pressed as the winding core rotates with the rotating body, wherein the winding core includes:

a winding core main body having an elongated shape, a first portion which is located at the first end portion in an axial direction of the winding core main body and is coupled to the rotating body, a second portion which is located at the second end portion in the axial direction of the winding core main body, is movable in the axial direction, and presses against the non-rotating body, a first elastic body which urges the second portion outward along the axial direction, and a sheet holding portion configured to hold an end portion of a sheet, and wherein, when the rotating body rotates the winding core while the sheet holding portion is holding the end portion of the sheet, the sheet is wound around the winding core.

2. The sheet winding mechanism according to claim 1, wherein the first portion is also movable in the axial direction and the winding core further includes a second elastic body which urges the first portion outward along the axial direction.

3. The sheet winding mechanism according to claim 2, wherein the first elastic body urges the second portion with a force greater than a force with which the second elastic body urges the first portion.

4. The sheet winding mechanism according to claim 2, wherein each of the first and second elastic bodies comprise a spring, and wherein a spring constant of the first elastic body is greater than a spring constant of the second elastic body.

5. The sheet winding mechanism according to claim 1, wherein the first portion rotates with and does not move relative to the winding core main body.

6. A printer comprising:

a sheet winding mechanism including a detachable winding core, a rotating body which is coupled to a first end portion of the winding core to rotate the winding core, and a non-rotating body against which a second end of the winding core is pressed as the winding core rotates with the rotating body; and a printing unit configured to print information on the sheet, wherein the winding core includes:

a winding core main body having an elongated shape, a first portion which is located at the first end portion in an axial direction of the winding core main body and is coupled to the rotating body, a second portion which is located at the second end portion in the axial direction of the winding core main body, is movable in the axial direction, and presses against the non-rotating body, a first elastic body which urges the second portion outward along the axial direction, and a sheet holding portion configured to hold an end portion of a sheet, and wherein, when the rotating body rotates the winding core while the sheet holding portion is holding the end portion of the sheet, the sheet having information printed thereon by the printing unit is wound around the winding core.

7. The printer according to claim 6, wherein the first portion is also movable in the axial direction and the winding core further includes a second elastic body which urges the first portion outward along the axial direction.

8. The printer according to claim 7, wherein the first elastic body urges the second portion with a force greater than a force with which the second elastic body urges the first portion.

9. The printer according to claim 7, wherein each of the first and second elastic bodies comprise a spring, and wherein a spring constant of the first elastic body is greater than a spring constant of the second elastic body.

10. The printer according to claim 6, wherein the first portion rotates with and does not move relative to the winding core main body.

11. The printer according to claim 6, wherein the non-rotating body has a concave surface and the second portion has a convex-shaped end that is pressed against the concave surface.

12. The printer according to claim 6, wherein the rotating body has one of a claw or a groove formed thereon at a position facing the first portion, and the first portion is one of a groove or a claw which engages one of the claw or the groove formed on the rotating body.

13. The printer according to claim 6, wherein the sheet holding portion comprises a cut formed on the winding core in the axial direction of the winding core and an edge of the sheet is inserted into the cut when held by the sheet holding portion.

14. A sheet winding mechanism comprising:

a rotating body;

a non-rotating body; and a winding core coupled to the rotating body to rotate with the rotating body, the winding core having a first portion that engages with the rotating body, a second portion that is pressed against and rotatable with respect to the non-rotating body, a sheet holder configured to hold an end portion of a sheet, and a first spring that urges the second portion outward along the axial direction against the non-rotating body, wherein, when the rotating body rotates the winding core while the sheet holder is holding the end portion of the sheet, the sheet is wound around the winding core.

15. The sheet winding mechanism according to claim 14, wherein the first portion is also movable in the axial direction and the winding core further includes a second spring which urges the first portion outward along the axial direction against the rotating body.

16. The sheet winding mechanism according to claim 15, wherein a spring constant of the first spring is greater than a spring constant of the second spring.

17. The sheet winding mechanism according to claim 14, wherein the first portion rotates with and does not move relative to the winding core main body.

18. The sheet winding mechanism according to claim 14, wherein the non-rotating body has a concave surface and the second portion has a convex-shaped end that is pressed against the concave surface.

19. The sheet winding mechanism according to claim 14, wherein the rotating body has one of a claw or a groove formed thereon at a position facing the first portion, and the first portion is one of a groove or a claw which engages one of the claw or the groove formed on the rotating body.

20. The sheet winding mechanism according to claim 14, wherein the sheet holder comprises a cut formed on the winding core in the axial direction of the winding core and an edge of the sheet is inserted into the cut when held by the sheet holder.

* * * * *